United States Patent [19]

Laufer et al.

[11] Patent Number: 4,548,184

[45] Date of Patent: Oct. 22, 1985

[54] APPARATUS FOR THE LOAD-DEPENDENT ACTUATION OF AN ADJUSTING DEVICE OF AN INTERNAL COMBUSTION ENGINE

[75] Inventors: Helmut Laufer, Stuttgart; Wolf Wessel, Oberriexingen, both of Fed. Rep. of Germany

[73] Assignee: Robert Bosch GmbH, Stuttgart, Fed. Rep. of Germany

[21] Appl. No.: 413,303

[22] Filed: Aug. 31, 1982

[30] Foreign Application Priority Data

Sep. 5, 1981 [DE] Fed. Rep. of Germany ..... 3135234

[51] Int. Cl.[4] ..... F02M 39/00; F02M 25/06

[52] U.S. Cl. ..... 123/569; 123/449

[58] Field of Search ..... 123/568, 569, 449, 503, 123/372, 373

[56] References Cited

U.S. PATENT DOCUMENTS

| | | | |
|---|---|---|---|
| 3,946,713 | 3/1976 | Laufer | 123/449 |
| 4,205,645 | 6/1980 | Eheim | 123/569 |
| 4,228,773 | 10/1980 | Stumpp et al. | 123/505 |
| 4,253,439 | 3/1981 | Höfer | 123/368 |
| 4,300,515 | 11/1981 | Straubel et al. | 123/568 |
| 4,495,929 | 1/1985 | Maeda | 123/569 |

FOREIGN PATENT DOCUMENTS

| | | | |
|---|---|---|---|
| 0096158 | 6/1983 | Japan | 123/569 |

*Primary Examiner*—Carl Stuart Miller

*Attorney, Agent, or Firm*—Edwin E. Greigg

[57] ABSTRACT

An apparatus for the load-dependent actuation of an adjusting device of an internal combustion engine, in particular of a throttle valve, of an exhaust gas recirculation line leading to the intake tube of the engine, in which the adjusting device is controlled in accordance with the position of a governor sleeve of a governor of an injection pump filled with fuel. The fuel in the injection pump, which is at an interior pressure ($p_1$), is utilized as a hydraulic operating medium, and the position of the governor sleeve is ascertained via a self-balancing hydraulic follower piston apparatus. In order to preclude influence on the part of the interior pressure ($p_1$), which is dependent on the pump rpm, the follower piston apparatus is disposed such that in the balanced status it is exposed on both ends to a pressure corresponding to the interior pressure ($p_1$).

2 Claims, 7 Drawing Figures

-P1-
-P1-

130
134
139
51
136
151
132
153
135
138
155
154
147
144
146
150
S
18
142a
143
145
142b
141
144
138
19
82
80b
83
79
81
78
S,VL
80a
33
43
40
25
-P1-
137
152
148
140
149
A
2A 140
130
134
133
139
51
136
132
131
138
135
144
147
146
150
S
F
142
18
142a
143
145
142b
141
144
138
19
82
80b
80
79
78
81
83
80a
33
S,VL
40
43
-P1-
25
137
149
148
A
2A

APPARATUS FOR THE LOAD-DEPENDENT ACTUATION OF AN ADJUSTING DEVICE OF AN INTERNAL COMBUSTION ENGINE

BACKGROUND OF THE INVENTION

The invention is based on an apparatus as generally described hereinafter. In order to reduce the proportion of toxic substances in the exhaust gases of internal combustion engines, it is known to perform a recirculation of controlled quantities of the exhaust gas back to the intake tube of the engine. Conventionally, an exhaust gas recirculation line is carried from the exhaust gas side of the engine back to the intake tube, and the quantity of recirculated gas is adjusted by means of a throttle valve. In German Offenlegungsschrift No. 2658052, an apparatus is described for the load-dependent actuation of a throttle valve of an exhaust gas recirculation apparatus, in which the throttle valve determining the quantity of recirculated exhaust gas is actuated by a hydraulic servomotor, which obtains its operating medium from the suction chamber of the injection pump. The quantity of the fuel supplied in this manner to the hydraulic servomotor is controlled by means of a throttle, which is adjustable in accordance with the position of a governor sleeve in the governor of the injection pump. It is true that precise load-dependent control of the exhaust gas recirculation rate is attained in this manner; however, the use of the fuel existing in the interior of the injection pump as a hydraulic operating medium may result in inaccuracies, because the pressure in the suction chamber of the injection pump is dependent upon its rpm.

OBJECT AND SUMMARY OF THE INVENTION

The apparatus according to the invention has the advantage over the prior art that precise load-dependent control of the exhaust recirculation rate is possible regardless of the pump rpm at a particular time or in other words regardless of the particular interior pressure of the pump, which is determined by given tolerances and dependent on rpm.

By means of the characteristics disclosed in the specification, further advantageous further embodiments of the apparatus disclosed in the claims are possible.

Thus on the one hand, types of apparatus are proposed in which the position of the governor sleeve is transmitted directly to a follower piston, on which adjusting means can be attached for actuating the throttle valve; on the other hand, for the sake of increased flexibility in mounting the apparatus according to the invention, it is also possible to dispose the means for picking up the position of the governor sleeve and the adjusting member itself in a spatially separated manner, connecting them solely by means of hydraulic lines. By means of various types of embodiments of the hydraulic adjusting member, it is possible to realize differing travel characteristics or to provide precise rpm-dependent means for influencing this characteristic.

The precisely selected introduction of resilient elements into the hydraulic adjusting member also makes it possible to attain a particularly stable regulating characteristic, with an additional adjustment of the characteristic curve being possible as needed.

The invention will be better understood and further objects and advantages thereof will become more apparent from the ensuing detailed description of preferred embodiments taken in conjunction with the drawings.

DESCRIPTION OF THE EXEMPLARY EMBODIMENTS

Figure 1:
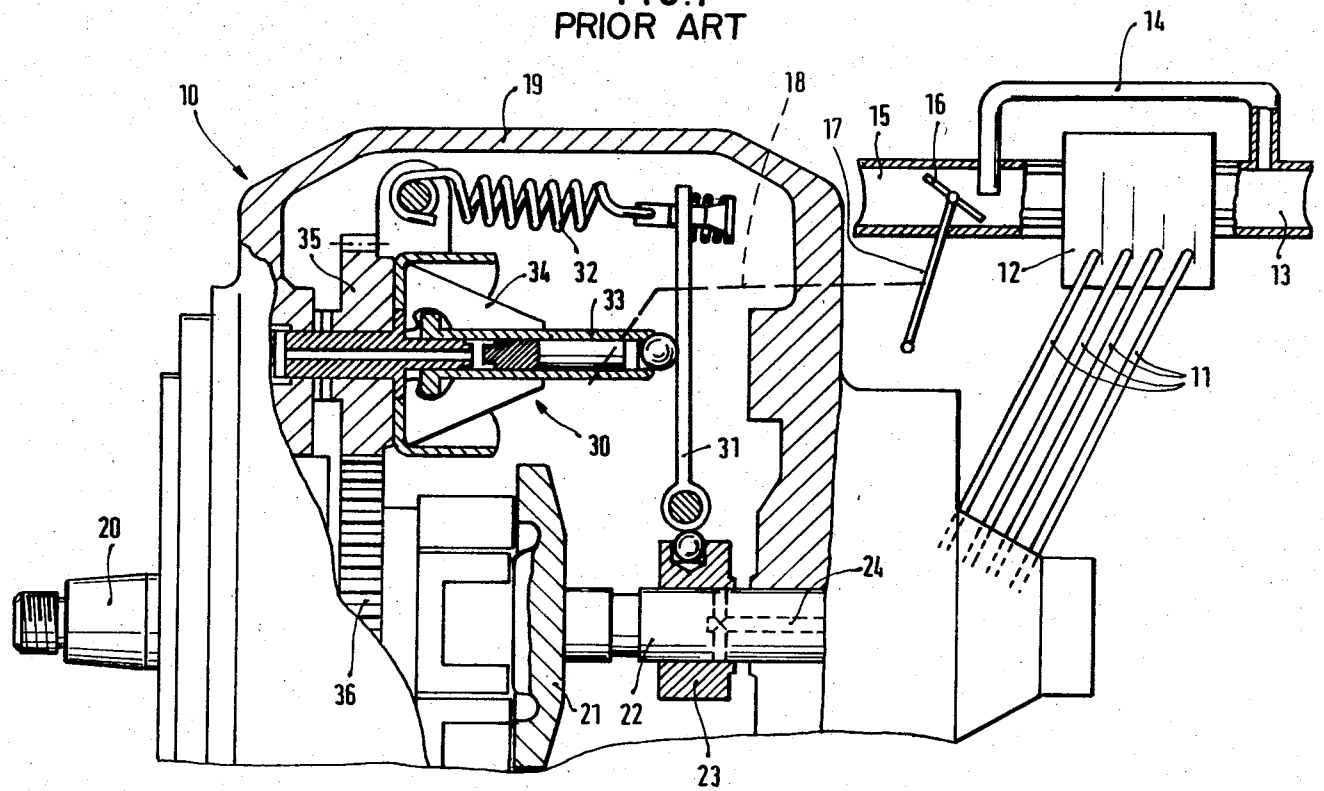
FIG. 1 PRIOR ART
FIG. 1 is a schematic representation of an apparatus for the load-dependent actuation of a throttle valve of an exhaust gas recirculation system in accordance with the prior art.

In FIG. 1 an injection pump 10 is shown which is connected via lines 11 with an internal combustion engine 12 of a motor vehicle. The engine 12 has an exhaust manifold line 13, which communicates via an exhaust gas recirculation line 14 with the intake tube 15 of the engine 12. A throttle valve 16 which is actuatable via a linkage rod 17 is disposed at the end of the exhaust recirculation line 14 in the intake tube 15. The linkage rod 17 is triggered in accordance with a position assumed in the injection pump 10, as is indicated by the dashed line 18.

The injection pump 10 has a pump housing 19 in which a drive shaft 20 is disposed. The drive shaft 20, in a manner known per se, actuates an eccentric disk 21 and a pump piston 22, on which a control slide 23 is movably disposed. The injection pump in this case is a distributor-type injection pump of known design, in which the stroke of the pump piston 22 is determined by means of the position of the control slide 23 acting as a fuel quantity adjusting device, and the pump work chamber, not shown, communicates beyond the pump piston 22 via a relief conduit 24 with the suction chamber 25 of the injection pump 10. In accordance with the principle on which this distributor injection pump is constructed, the pump piston 22 executes a simultaneously reciprocating and rotating movement. The adjustment of the control slide 23 is effected in a known manner by means of a centrally supported lever 31, which is connected at one end with the control slide 23 and on the other end is subjected to at least one governor spring 32 having an adjustable initial stress. Counter to the force of this spring 32, a governor sleeve 33 of a centrifugal governor engages the lever 31 in a known manner, the centrifugal governor being embodied by flyweights 34 and being driven by the drive shaft 20 by means of gear wheels 35, 36. Depending upon the initial stress of the governor spring 32, the governor sleeve 33 is displaced to a greater or lesser extent, beginning at a predetermined high rpm, so that the control slide 23 as well assumes a higher or lower position relative to the pump piston 22. The position of the governor sleeve 33 is thus a standard for the established fuel supply quantity or for the particular predetermined load at that time.

The dashed line 18 in FIG. 1 indicates that the deflections of the linkage rod 17 of the throttle valve 16 are dependent on the deflection of the governor sleeve 33 and thus on the load.

Figure 2:
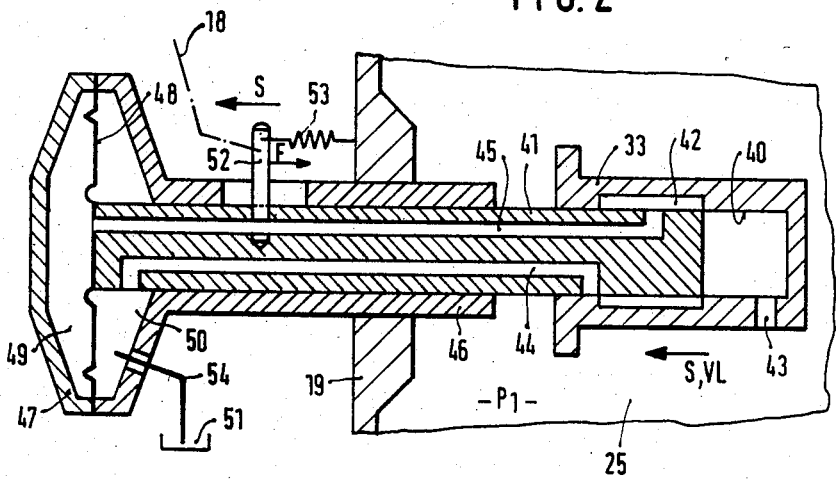
FIGS. 2 and 3 show two exemplary embodiments of a follower piston arrangement in accordance with the invention having a direct pickup of the governor sleeve position.

In FIG. 2, the pump housing 19 can again be seen, having the suction chamber 25 in which the internal pressure $p_1$ prevails. The governor sleeve 33 has a blind bore 40, which communicates via bore 43 with the suction chamber 25. One end of a follower piston 41 slides within the blind bore 40. The blind bore 40 of the governor sleeve 33 has an annular groove 42, which in the balanced position of the follower piston 41 is covered by this piston 41. The follower piston 41 has two axially disposed conduits 44, 45 and these are arranged to extend furthermore within a sheath 46 which is disposed stationary within the pump housing 19. The other end of the following piston 41 is secured on a diaphragm 48, which divides a box 47 adjoining the sheath 46 into two chamber halves 49, 50. One chamber half 49 of the box 47 communicates via the conduit 45 with the annular groove 42. The other chamber half 50 of the box 47 is connected first via a line 54 to a pressure-free tank 51 and second to the conduit 44, which leads to the other end of the follower piston 41 and, given a corresponding position of the follower piston 41, communicates with the annular groove 42. Finally, a pin 52 is also connected in an articulated manner with the follower piston 41, being initially stressed with an initial stressing force F with respect to the pump housing 19 by means of a spring 53. A linkage rod not shown in the drawing but indicated by the line 18 and leading to the linkage rod 17 of the throttle valve 16 engages this pin 52.

The mode of operation of the apparatus shown in FIG. 2 is as follows:

In the balanced position of the follower piston 41 shown in FIG. 2, the chamber half 49 of the box 47 communicates with the annular groove 42, and this annular groove 42 is blocked off from the outside by the follower piston 41. The other chamber half 40 thus communicates solely with the tank 51 and is thus pressure-free. If the sleeve 33 is now displaced toward the right, the annular groove 42 is brought into communication with the suction chamber 25. Fuel then flows at pressure $p_1$ via the annular groove 42 and the conduit 45 into the chamber half 49, and the follower piston 41 is deflected toward the right, that is, following up the movement of the governor sleeve 33, until the follower piston 41 again closes the annular groove 42. If on the other hand the governor sleeve 33 is deflected toward the left, the conduit 44 comes into communication with the annular groove 42, so that an equalization of pressure of the chamber halves 49, 50 occurs via the conduit 45, and the diaphragm 48, which had previously been deflected toward the right, is now deflected back toward the left, and here again the follower piston 41 follows up the movement of the governor sleeve 33. An arbitrary amplification of force is possible by means of the diaphragm 48 via the selection of the effective cross sectional areas of the diaphragm 48 and the follower piston 41.

In FIG. 2 and subsequent figures, the direction of the deflection of the governor sleeve 33 and of the particular element following it in a given figure is marked s, and the direction of s agrees with the full-load direction VL.

Figure 3:
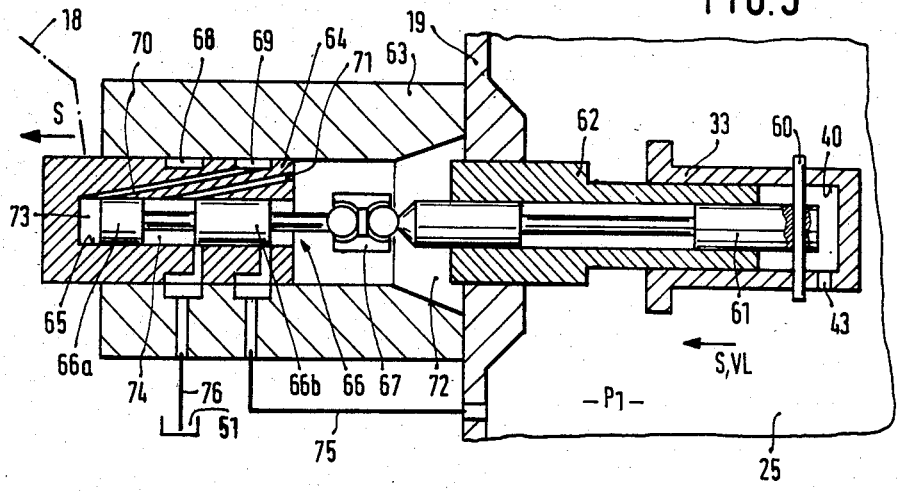

In FIG. 3, the governor sleeve 33 and the blind bore 40 and the bore 43 are again seen. In contrast to the apparatus shown in FIG. 2, however, the governor sleeve 33 is connected in this case via a pin 60 with a piston 61, which travels within a bore provided in guide 62 disposed in the pump housing 19. A guide housing 63 is flanged from the outside to the pump housing 19, and a follower piston 64 travels in turn within the guide housing 63. The follower piston 64 has a blind bore 65, in which a pre-control slide valve 66 having two axially offset control collars **66*a*, 66*b* such as known in spool valves is movably disposed. The piston 61 and the pre-control slide 66 are connected together via a universal joint 67 in order to compensate for the axial offset arrangement of the elements 66, 61. The follower piston 64 has a first annular groove 68 and a second annular groove 69. A first conduit 70 leads from the second annular groove 69 to the chamber 73 at the end of the blind bore 65. Leading from the chamber 72 between the pump housing 19 and the follower piston 64 is a second conduit 71 which leads to the chambered area 74 between the control collars 66*a*, 66*b*. A line 76 leads from the first annular groove 68 to the pressure-free tank 51, and a line 75 leads from the second annular groove 69 to the suction chamber 25 from the injection pump 10**.

The mode of operation of the apparatus shown in FIG. 3 is as follows:

In the balanced position of the follower piston 64 shown in FIG. 3, the inlets of the annular grooves 68, 69 to the blind bore 65 in the follower piston 64 are closed. In contrast, the conduits 70, 71 are opened. If the governor sleeve 33 is now deflected toward the right, then the inlet of the first annular groove 68 to the blind bore 65 would be opened, as a result of which fuel is capable of flowing out of the chamber 72 via the second conduit 71 into the tank 51. The follower piston 64 thereby moves toward the right and thus follows up the movement of the governor sleeve 33. If the governor sleeve 33 is deflected instead toward the left, the connection between the second annular groove 69 and the blind bore 65 is opened, and fuel flows out of the suction chamber 25 at the pressure $p_1$ over the line 75, the second annular groove 69, and the blind bore 65 into the chamber 72, as a result of which the follower piston 64, following up the movement of the governor sleeve 33, is likewise deflected toward the left. The balance of forces at the piston apparatus 61, 66 is thus always assured by the bore 43, which provides an internal pressure $p_1$ in the blind bore 40 in the governor sleeve 33, and via the first conduit 70, which again connects the chamber 73 at the bottom of the blind bore 65 with suction chamber 25 via the annular groove 69 and the line 75.

In the apparatus according to FIG. 3, the position of the governor sleeve 33 is picked up at the follower piston 64, as is indicated by the line 18. In contrast to the apparatus of FIG. 2, that of FIG. 3 has the advantage that the required elements, in particular the guide housing 63, are capable of being flanged onto the pump housing from the outside. Furthermore, the position of the follower piston 64 can be picked up at the end of the piston and does not have to be carried to the outside via a further sealing point located as in FIG. 2 between the follower piston 41 and the sheath 46.

Figures 4, 5:
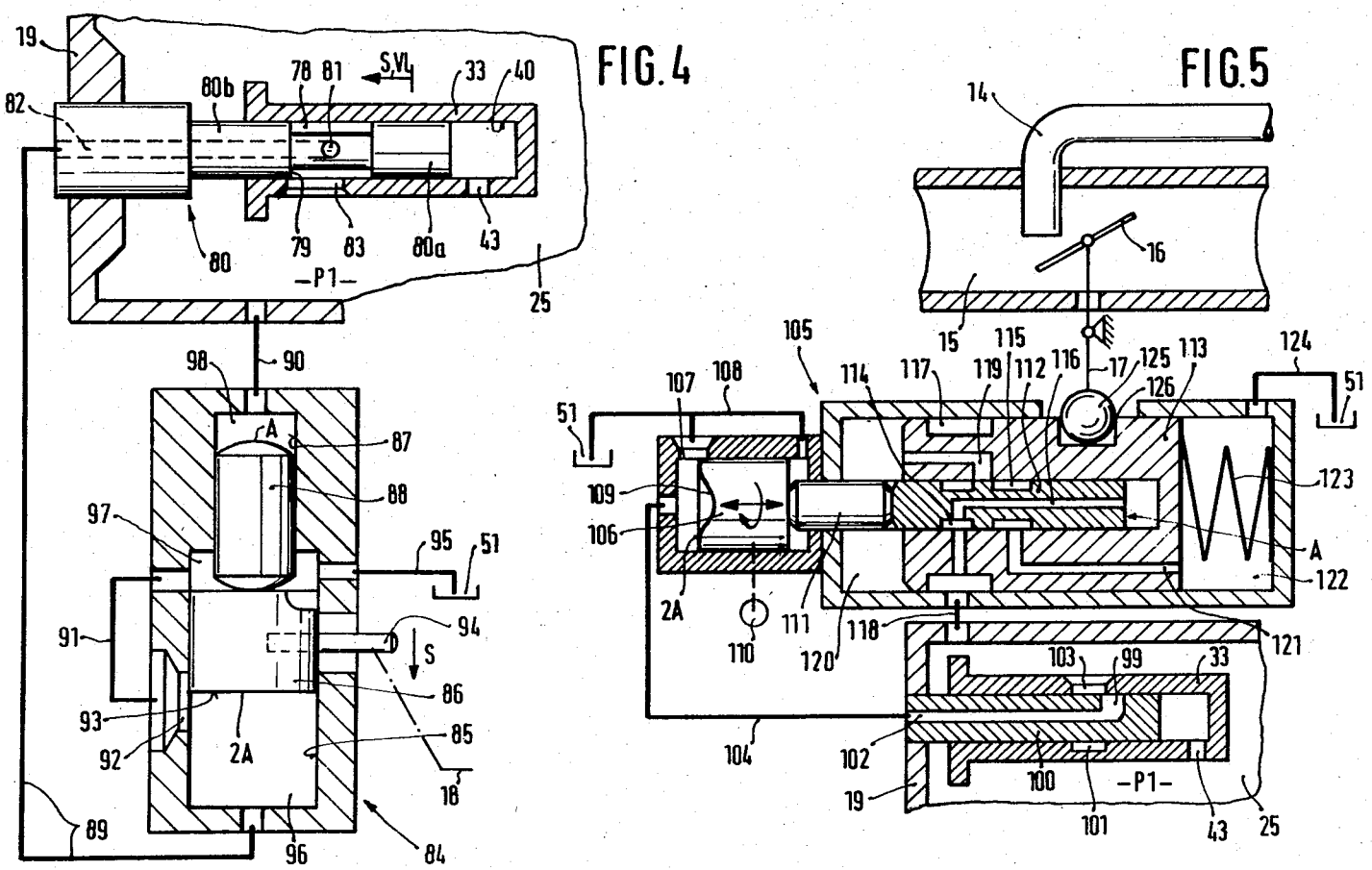
FIGS. 4 through 7 show three further forms of embodiment of follower piston apparatus according to the invention having a separately disposed hydraulic adjusting member.

In FIG. 4, a further form of embodiment of an apparatus according to the invention is shown, in which the pickup of the governor sleeve position and the pickup of the adjusting member are spatially separated from one another. Reference numeral 19 again indicates the pump housing and 25 indicates the suction chamber in which the interior pressure $p_1$ prevails. The governor sleeve 33 again has a blind bore 40 having the bore 43 to the suction chamber 25. In this exemplary embodiment, one end of a pre-control slide valve 80 having two axially offset control collars **80*a*, 80*b* slides within the blind bore 40. In the annular groove between the control collars 80***a*, 80*b* is located a bore 81, which communicates with an axial conduit 82 in a pre-control slide 80 and thus represents a connection between the chamber 78 and the outside, the chamber 78 being located between control collars 80*a* and 80*b*. A first control slit 83 is located in the wall of the governor sleeve 33 such that the control slit 83 cooperates with a control edge 79 of the control collar 80*b*, which it is understood can be arranged to partially cover the control slit 83.

A hydraulic adjusting member 84 is further provided, which has a first bore 85, in which a follower piston 86 is adapted to travel, and a second bore 87, in which a piston 88 striking against the follower piston 86 is also adapted to travel. The effective cross sections of the follower piston 86 and the piston 88 are in a predetermined relationship with one another, preferably at a ratio of 2:1, as is indicated by the symbols 2A and A. A line 89 leads from the conduit 82 to a chamber 96 at one end of the follower piston 86. A further line 90 leads from the suction chamber 25 to a chamber 98 at the end of the piston 88 remote from the follower piston 86. A further line 91 leads from a second control slit 92 at the chamber 96, which is partially covered by a control edge 93 of the follower piston 86, to a chamber 97 between the pistons 86, 88, and this chamber 97 is connected in turn via a line 95 with the pressure-free tank 51.

The mode of operation of the apparatus shown in FIG. 4 is as follows:

From the suction chamber, a quantity of fuel flows via the first slit 83, the conduit 82, the line 89, the chamber 96, the second control slit 92, and the lines 91, 95 to the follower piston 86, which depends upon the prevailing internal pressure and the slit length opened up at that time. Given a selected ratio of the effective cross sectional areas of the pistons 86, 88 of 2:1, the communication of the suction chamber 25 with the chamber 98 via the line 90 causes the apparatus comprising the pistons 88, 86 to be in balance whenever a pressure prevails in chamber 96 that is half as great as the pressure $p_1$ in the suction chamber 25. Given control slits 83, 92 of identical embodiment, then the slit length must also be equal, because at each control slit a pressure drop of $p_{\frac{1}{2}}$ prevails. Now if in consequence of a deflection of the governor sleeve 33 in one or the other direction, the length of the slit 83 varies, then the follower piston 86 follows up this movement in the direction indicated s in FIG. 4, until the balance between the pistons 86, 88 has again been established by means of the appropriate ratio of the lengths of the slits 83, 92.

In so doing, it is also possible in accordance with the invention to give the slits 83, 92 a different width, so that a predetermined travel translation between the governor sleeve 33 and the follower piston 86 is attained. It is furthermore also possible to vary the width of the slit 92 over the course of the length, so that the overall result is a predeterminable characteristic of the travel translation.

In the adjusting apparatus for the governor sleeve 33 shown in FIG. 4, a relatively large fuel quantity flows in the idling position of the governor sleeve 33, while in contrast a relatively small fuel quantity flows in the full-load position VL. This mode of operation of the apparatus shown in FIG. 4 does provide for favorable economy in terms of fuel quantity for the injection pump 10; however, the adjusting speed in the full-load position is low. In contrast to that, a reversed disposition of the slit 83 with the opposing control edge of the piston 80*a* would produce greater demand for fuel, but would attain more rapid adjustment within the fullload range.

By means of the pin 94 attached to the follower piston 86, the throttle valve 16 is again actuated, as indicated by the line 18. It may happen with the apparatus shown in FIG. 4 that recoiling forces of the throttle valve produce errors in position. In order to compensate for these possible errors, although possibly at increased expense, an apparatus is provided in accordance with the invention such as is shown in FIG. 5.

In FIG. 5, the governor sleeve is again marked 33 and disposed in the suction chamber 25, in the blind bore 40 of which, however, a pre-control slide 100 operates, being disposed in a stationary manner on the pump housing 19. An annular groove 101, which communicates via a control slit 103 with the suction chamber 25 is located in the governor sleeve 33. The pre-control slide 100 has a bore 99, the control edge of which partially covers the control slit 103 and communicates with an axially disposed conduit 102 in the pre-control slide 100. A line 104 leads from the conduit 102 to a hydraulic adjusting member 105, in which a counterpart piston 106 travels. The counterpart piston 106 has a control edge 109, which partially covers a second control slit 107, which communicates in turn via a line 108 with the pressure-free tank 51. An actuation member 110 is furthermore connected in an articulated manner to the counterpart piston 106, and by means of the actuation member 110 the counterpart piston 106 can be rotated in a manner known per se about its longitudinal axis in accordance with the pressure $p_1$. On its end remote from the control edge 109, the counterpart piston 106 strikes against an intermediate piston 111 in a chamber which again communicates via the line 108 with the pressure-free tank 51. The intermediate piston 111 in turn strikes against a pre-control piston 112, which travels within a follower piston 113, which in turn is displaceably disposed within the hydraulic adjusting member 105. The effective cross sectional areas of the counterpart piston 106 and the pre-control piston 112 are at a predetermined ratio to one another, preferably 2:1.

The pre-control piston 112 has a first annular groove 114 and a second annular groove 115. The first annular groove 114 communicates via an axial conduit 116 in the pre-control piston 112 with the end of the pre-control piston 112 remote from the intermediate piston 111. A bore 117 furthermore leads from the first annular groove 114 to a line 118 which leads to the suction chamber 25. The follower piston 113 has a control bore 119, with which the chamber 120 on the end of the follower piston 113 oriented toward the intermediate piston 111 can be connected with either the first annular groove 114 or the second annular groove 115, depending upon the position of the pre-control piston 112. A conduit 121 furthermore leads within the follower piston 113 from the second annular groove 114 to the chamber 122 located opposite the chamber 120. In the chamber 122, a spring 123 supports the follower piston 113 relative to the housing of the hydraulic adjusting member 105. A line 124 connects this chamber 122 with the pressure-free tank 51. Finally, a recess 126 is provided in the follower piston 113 for receiving a ball 125, which is articulated onto the linkage rod 17 of the throttle valve 16.

The mode of operation of the apparatus shown in FIG. 5 is as follows:

As already explained for the apparatus according to FIG. 4, the selection of the cross sections of the pistons 106, 112 in combination with the control slits 103, 107 and the exposure of the pre-control piston 112 on its end remote from the counterpart piston 106 to the pressure $p_1$ via the line 118, the bore 117 and the conduit 116 causes a balance to be established at the pistons 106, 112 at such time as the pressure $p_1$ is divided in half by the slits 103, 107. In the apparatus according to FIG. 5, the result is also a follow-up of the counterpart piston 106 with respect to the governor sleeve 33 in the described manner. However, the movement of the counterpart piston 106 is transmitted onto the follower piston 113 in such a manner that a stable position of the follower piston 113 is the result, particularly with respect to recoil forces arising at the linkage rod 17. As seen in FIG. 5, this is attained in that the balanced position of the follower piston 113, the chamber 120 is closed, because the control bore 119 is blocked by the pre-control piston 112. Accordingly, it is not possible for the follower piston 113 to move at that time. If the pre-control piston 112 is then deflected toward the right, the chamber 120 comes into communication with the suction chamber 25 via the control bore 119, the annular groove 114, the bore 117 and the line 118, and fuel flows from the suction chamber 25 into the chamber 120, so that the follower piston 113 is likewise deflected toward the right until the pre-control piston 112 again closes the control bore 119. If on the other hand the pre-control piston 112 is deflected toward the left, then the chamber 120 comes to communicate with the pressure-free tank via the control bore 119, the annular groove 115, the conduit 121, the chamber 122, and the line 124, so that fuel flows out of the chamber 120 and the follower piston 113 is displaced toward the left until the control bore 119 is again closed by the pre-control piston 112. As can be seen from this, the follower piston 113 acccordingly follows up the movement of the governor sleeve 33 and after this movement is terminated assumes a stable final position which cannot be changed by recoil forces.

In accordance with the invention the counterpart piston 106 can additionally be rotated via the actuation member 110, and the actuation member 110 is adjustable in accordance with the pressure $p_1$, that is in accordance with rpm, in a manner known per se. If the control edge 109 of the counterpart piston 106 is embodied over its circumference in accordance with a predetermined characteristic curve, then an rpm-dependent correction of the follow-up movement of the follower piston 113 can thereby be attained.

Figure 6:
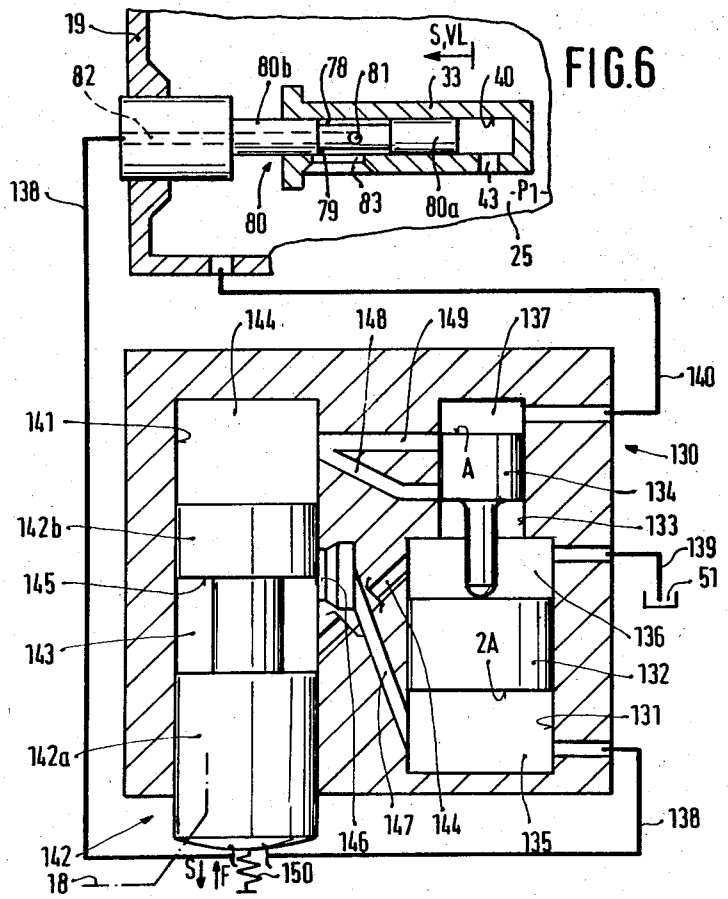

In the further form of embodiment of an apparatus according to the invention shown in FIG. 6,a separation of the pickup of the governor sleeve position and of the hydraulic adjusting member is again provided. The pickup of the governor sleeve position is effected in the same manner as in the exemplary embodiment shown in FIG. 4, identical reference numerals being used, and the reader is referred to the discussion relating to FIG. 4 above. However, the hydraulic adjusting member 130 of FIG. 6 differs from the form of embodiment of FIG. 4 in that a second hydraulic circuit is provided in order to prevent recoiling actions caused by the forces of the linkage rod 17 of the throttle valve 16.

To this end, the hydraulic adjusting member 130 has a first bore 131, in which a first piston 132 travels, and a second bore 132, in which a second piston 134 travels, this piston further including means which strike against the first piston 132. The cross sections of the pistons 132, 134 again are at a predetermined ratio to one another, preferably 2:1. The chamber in the bore 131, on the end of piston 132 remote from the piston 134, is marked 135; the chamber between the pistons is marked 136; and the chamber on the piston 134 correspondingly remote from the piston 132 is marked 137. A line 138 leads from the conduit 82 in the pre-control slide 80 to the chamber 135; a line 139 leads from the chamber 136 to the pressure-free tank 51; and a line 140 finally leads from the suction chamber 125 to the chamber 137. The hydraulic adjusting member 130 furthermore has a further blind bore 141, in which a follower slide 142 having two axially offset pistons **142*a*, 142*b* travels. The chamber between the pistons 142*a*, 142*b* is marked 143, and a chamber at the bottom of the blind bore 141 is marked 144. At its end oriented toward the chamber 143, the piston 142*b* has a control edge 145, which partially covers a further control slit 146 on the blind bore 141. The further control slit 146 communicates with the chamber 135 via a conduit 147. Two conduits 148, 149 lead from the chamber 144 to the second bore 133, and can be connected with either the chamber 133 or the chamber 137, depending upon the position of the second piston 134. A compression spring 150 is disposed on the end of the follower slide 142 protruding out of the blind bore 141, and this compression spring 150 supports the follower slide 142 relative to the housing of the hydraulic adjusting member 130 with a force F acting in the opposite direction from the direction s. At the same time, this end of the follower slide 142 is engaged by the linkage rod 117 of the throttle valve 16, again as indicated by the line 18**.

The mode of operation of the apparatus shown in FIG. 6 is as follows:

As a result of the flow of the fuel out of the suction chamber 25 via the slit 83, the conduit 82, the line 138, the chamber 135, the conduit 147, the control slit 146, the chamber 143, the conduit 144, the chamber 138, and the line 139 to the tank 51, a pressure drop again occurs at the slits 83, 146, which given the selected cross sections of the pistons 132, 134 and the exertion of pressure $p_1$ of the suction chamber 25 upon the piston 134 via the line 140 causes a follow-up movement on the part of the follower slide 142 which corresponds to the position of the governor sleeve 33. However, in contrast to the form of embodiment shown in FIG. 4, an indirect adjustment of the further slit 146 is performed, depending upon whether the chamber 144 is connected via the deflection of the piston 134 with the pressure-free tank 51 via the conduit 148 (that is, the follower slide 142 moves upward) or with the suction chamber 25 via the conduit 149 (that is, the follower piston 142 moves downward). Since in this exemplary embodiment the measurement circuit (pistons 132, 134) and the servocircuit (follow-up slide 142) are separated, the adjusting speed can be high despite the small measurement quantity flowing through the slits 83, 146. Since furthermore, in the balanced status of the hydraulic adjusting member 130, the piston 134 closes the conduits 148 and 149 and thus the chamber 144 as well, a recoiling effect of forces via the linkage rod 18 upon the follower piston 142 such as to cause falsification of the position ascertained is not possible.

However, it must be taken into account that in the exemplary embodiment according to FIG. 6 a possible leakage quantity at the piston 132 could represent an absent measurement quantity for the comparison slit 146 and could thus cause errors in position.

Figure 7:
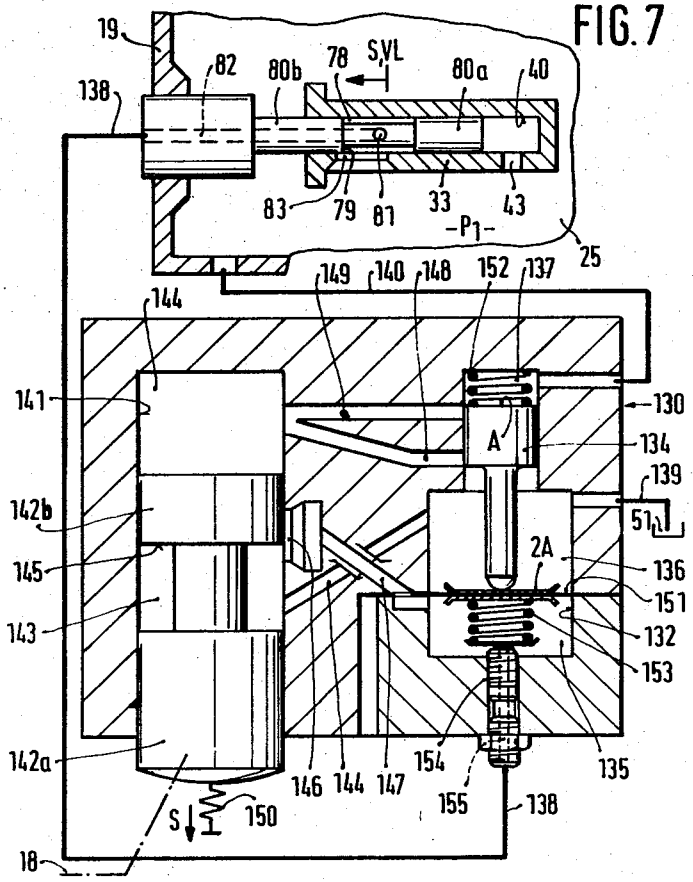

This possible disadvantage if the hydraulic adjusting member 130 is manufactured imprecisely is avoided with the apparatus according to the exemplary embodiment shown in FIG. 7.

The apparatus according to FIG. 7 is identical to that of Fig.6 except that instead of the piston 132 there is a diaphragm 151, which divides the chambers 135, 136 from one another. The piston 134 is embodied such that it strikes against the diaphragm 151. The diaphragm 151 can be deflected in accordance with the pressures prevailing in the chambers 134, 136 in the same manner as the piston 132 in the apparatus of FIG. 6; however, because the diaphragm 151 is firmly fastened in the housing of the adjusting member 130, a leakage flow between the chambers 135, 136 is not possible.

Furthermore, the diaphragm 151 and the piston 134 in the apparatus of FIG. 7 are supported by springs 153, 152. These springs convert the integral behavior of the apparatus represented by the pistons 132, 134 of FIG. 6 into a proportional behavior. The hydraulic connection of the piston apparatuses 132, 134 or 142 in FIG. 6 in fact represents, in terms of regulation technology, a series circuit of two integral regulators, which under certain conditions may cause instability in the regulating behavior. If in contrast to this, one of the regulating paths, in FIG. 7 accordingly the right-hand half of the adjusting member 130, is converted into a proportional regulator, then the result is a substantially stabilized regulating behavior. It will be understood that these springs 152, 153 can also be used in the apparatus shown in FIG. 6. An adjusting screw 154 is advantageously also provided for the spring 153, being provided with a bore 155 for passing the line 138 into the chamber 135. An adjustment of the proportional characteristic is possible with this adjusting screw 154. It is also possible in accordance with the invention to attain a precisely selected travel characteristic of the hydraulic adjusting member 130 of FIG. 6 or FIG. 7 by means of the selection of different spring stiffnesses for the springs 152, 153. For instance, deviating from the linear travel transmission that occurs when the spring stiffnesses are identical, it is possible at small pressures $p_1$ (in a distributor injection pump, this corresponds to a low rpm), to make the travel dependent on the movement of the governor sleeve 33 in either an overproportional or an underproportional manner, depending upon the greater or lesser initial stress of the spring 152 or the spring 153; in this manner, it is for instance possible to perform a correction of the exhaust recirculation throttle valve 16.

It will naturally also be understood that in the exemplary embodiments according to FIGS. 5–7 as well, the slit widths or shapes can be varied, such as has been discussed in connection with the form of embodiment of FIG. 4; on the other hand, the rpm connection according to FIG. 5 is naturally applicable as well to the forms of embodiment shown in FIGS. 4, 6 and 7.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for the load-dependent actuation of an exhaust gas recirculation (egr) quantity adjusting device of an internal combustion engine in combination with a fuel injection pump, said engine including an air intake tube, an exhaust gas tube and an exhaust recirculation line connecting said exhaust gas tube to said intake tube, the fuel injection pump including a suction chamber adapted to be filled with pressurized fuel, a fuel quantity adjusting device, and a governor comprising a governor sleeve for actuation thereof, said governor sleeve being pressure-balanced and serves to control said egr quantity adjusting device of the internal combustion engine, the apparatus comprising:

a self-balancing hydraulic follower piston apparatus operationally connected to said governor and comprising a sheath within which a positioning piston is movably connected to actuate said egr quantity adjusting device, said governor sleeve being embodied as a movable part of a valve means of said follower piston apparatus controlling a pressure line which connects said suction chamber to a blind bore in said governor sleeve adjacent to a face of said positioning piston in which said positioning piston is provided with a control edge by means of which a connection from said blind bore to a relief line is controllable such that said positioning piston is biased by pressure in the blind bore in a direction which opens said connection to said relief line.

2. The apparatus as defined in claim 1, wherein the governor sleeve defines said blind bore and includes an annular groove, the blind bore communicating with said suction chamber, one end of said positioning piston slides within the blind bore, said positioning piston including two axial conduits, one of which is connected to the annular groove;

a stationary box;

a diaphragm in said stationary box to which one end of the positioning piston is articulated, said diaphragm being situated with said stationary box where said diaphragm divides said stationary box into two chamber halves, each chamber being connected to a respective one of said two axial conduits;

a pressure-free tank with which one of the two chamber halves communicates; and a prestressed pin articulated onto the positioning piston and connected to actuate a throttle of said egr quantity adjusting device of the engine, and wherein:

(i) said annular groove and one of said axial conduits are closed in the balanced position of the positioning piston, with diaphragm displacement in one direction from the balanced position; and (ii) said annular groove communicating with said blind bore and the other axial conduit is closed, with diaphragm displacement in the opposite direction from the balanced position.

* * * * *